United States Patent [19]

Johnson

[11] Patent Number: 4,549,327

[45] Date of Patent: Oct. 29, 1985

[54] CLEANER AND CHALK DUST RECEPTACLE FOR CHALK BOARD ERASERS

[76] Inventor: Robert M. Johnson, 201 Mark St. SW., Decatur, Ala. 35601

[21] Appl. No.: 652,734

[22] Filed: Sep. 21, 1984

[51] Int. Cl.[4] ..... B43L 21/00; A47L 25/00

[52] U.S. Cl. ..... 15/236 R; 15/104 R; 15/142; 15/237; 434/417

[58] Field of Search ..... 15/142, 237, 257 R, 15/257.1, 1, 104 R, 221, 236 R; 220/1 T; 434/417

[56] References Cited

U.S. PATENT DOCUMENTS

| | | | |
|---|---|---|---|
| 1,870,333 | 8/1932 | Kadavy | 15/237 |
| 2,262,724 | 11/1941 | Hoffman | 15/237 |
| 2,843,870 | 7/1958 | Perry | 15/237 |
| 4,099,286 | 7/1978 | Ishikawa | 15/142 |
| 4,348,840 | 9/1982 | Strader | 15/236 R X |

*Primary Examiner*—Edward L. Roberts

*Attorney, Agent, or Firm*—Kenneth A. Roddy

[57] ABSTRACT

A cleaner and chalk dust receptacle for chalk board erasers comprises a box shaped container which is received and supported within a wall mounted cover member. The container has an open top, a bottom wall, a back wall, a front wall, and a pair opposed side walls which are provided with opposed outwardly arcuate convex beads extending longitudinally therealong, and the cover member has an open front, a top wall provided with an opening therethrough, a back wall, and a pair of side walls extending from the open front to the back wall. The interior surface of the side walls are provided with opposed arcuate concave grooves extending longitudinally therealong for slidably receiving the beads of the container. A scraper blade disposed on the top surface of the top wall extends transversely across the opening in the top wall for scraping chalk dust from the bottom surface of chalkboard erasers when they are drawn thereacross.

10 Claims, 8 Drawing Figures

CLEANER AND CHALK DUST RECEPTACLE FOR CHALK BOARD ERASERS

BACKGROUND OF THE INVENTION

1. Field of the Invention

This invention relates to cleaning and dust collecting devices, and more particularly to a cleaner and chalk dust receptacle for chalk board erasers.

2. Brief Description of the Prior Art

The cleaning of chalk board erasers has long been a messy and troublesome task. For this reason, the cleaning operation is usually postponed until several erasers are filled with chalk dust and require cleaning. The filled erasers are taken to an open area where the dust produced by the cleaning method will cause the least amount of harm from breathing the dust and settling on the surroundings. The cleaning operation heretofore consists primarily of beating two filled erasers together, or striking a filled eraser against a hard object such as the edge of a desk, generating clouds of dust which is inhaled by the person doing the cleaning and anyone else in the immediate area. When the dust settles, it covers the exposed surfaces of furniture, wall hangings, windows, and other objects in the cleaning area.

There are several patents which disclose various scraper and collection devices all of which are directed toward removing and collecting residue from the shoes of the user.

Perry, U.S. Pat. No. 2,843,870 discloses a shoe scraper and residue collector for vehicles comprising a flat plate mounted to the floor of the vehicle which receives a tapered rectangular receptacle having an open front end. The top of the receptacle is provided with a series of raised arcuate scraper elements facing toward the open end which open into the receptacle for scraping residue from the sole of a shoe.

Schneider, U.S. Pat. No. 1,042,977 discloses a boot cleaner comprising a rectangular pan member and a grate member having depending side walls which is removably mounted in the pan. The grate includes a series of spaced apart, upwardly extending scraping members which scrape dirt from the boot when moved thereacross.

Conner, U.S. Pat. No. 2,308,587 discloses a door mat adapted to prevent sand and mud from being carried into a room. The door mat comprises a container having an open top and an outwardly extending flange at its top edge. A frame is removably supported on the flange and includes an inwardly depending flange to which are secured a plurality of parallel scraper bars. The scraper bars have their upper edges disposed below the top of the frame, and a rubber mat is superposed upon the bars within the frame. The top of the mat is flush with the top of the frame.

Strader, U.S. Pat. No. 4,348,840 discloses a modular structure for trapping hazardous dust in a workspace comprising a shallow pan having a removable cover of expanded metal mesh. The pan may be engaged with other similar pans for assembling a walkway. The pan may be filled with liquid such as oil to retain the dust falling into the pan and dust being scraped from the shoes of a user by the expanded metal mesh.

The prior art in general, and none of these patents in particular, disclose a cleaner and chalk dust receptacle for chalk board erasers comprising a container member that has an open top, a bottom wall, a back wall, a front wall, and a pair opposed side walls which are provided with opposed outwardly arcuate convex beads extending longitudinally therealong, the container member being received and supported within a wall mounted cover member having an open front, a top wall provided with an opening therethrough, a back wall, and a pair of side walls extending from the open front to the back wall which are provided with opposed arcuate concave grooves extending longitudinally therealong for slidably receiving the beads of the container, and a scraper blade disposed on the top surface of the top wall extends transversely across the opening in the top wall for scraping chalk dust from the bottom surface of chalkboard erasers when they are drawn thereacross.

SUMMARY OF THE INVENTION

It is therefore an object of the present invention to provide a cleaner and chalk dust receptacle for chalk board erasers which will prevent the user from inhaling harmful chalk dust.

It is another object of this invention to provide a cleaner and chalk dust receptacle which will collect the dust from chalk board erasers as the erasers are being cleaned for disposal at a convenient time and location.

It is another object of this invention to provide a cleaner and receptacle for chalk board erasers which may be locked to prevent spilling of the contents or tampering by vandals or other unauthorized persons.

It is another object of this invention to provide a cleaner and receptacle for chalk board erasers which may be easily and conveniently mounted on a wall for safe use in a class room. Another object of this invention is to provide a cleaner and chalk dust receptacle having a simple, rugged, and durable construction and which is economical to manufacture.

Other objects of the invention will become apparent from time to time throughout the specification and claims as hereinafter related.

The above noted objects and other objects of the invention are accomplished by a cleaner and chalk dust receptacle comprising a open top box shaped container which is received and supported within a wall mounted cover member having an opening on its top wall and an upwardly projecting scraper blade extending thereacross for scraping the chalk from chalkboard erasers when they are drawn thereacross.

DESCRIPTION OF THE PREFERRED EMBODIMENT

Figure 1:
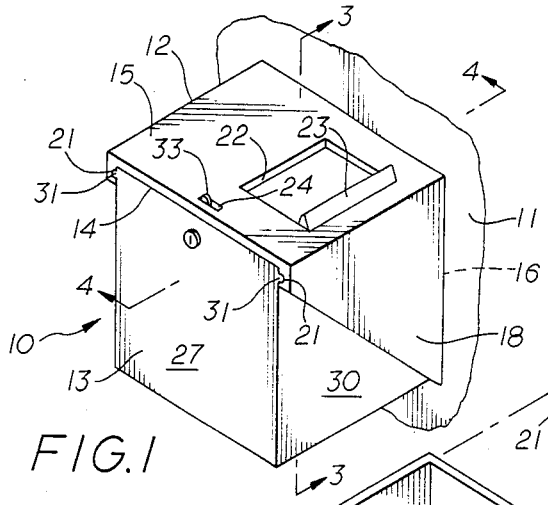
FIG. 1 is an isometric view of the cleaner and chalk dust receptacle for chalk board erasers in accordance with the present invention.
Figure 5:
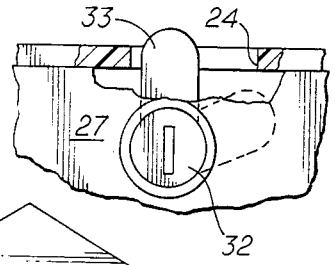
FIG. 5 is a partial front elevational view in partial cross section showing the locking detail.
Figure 2:
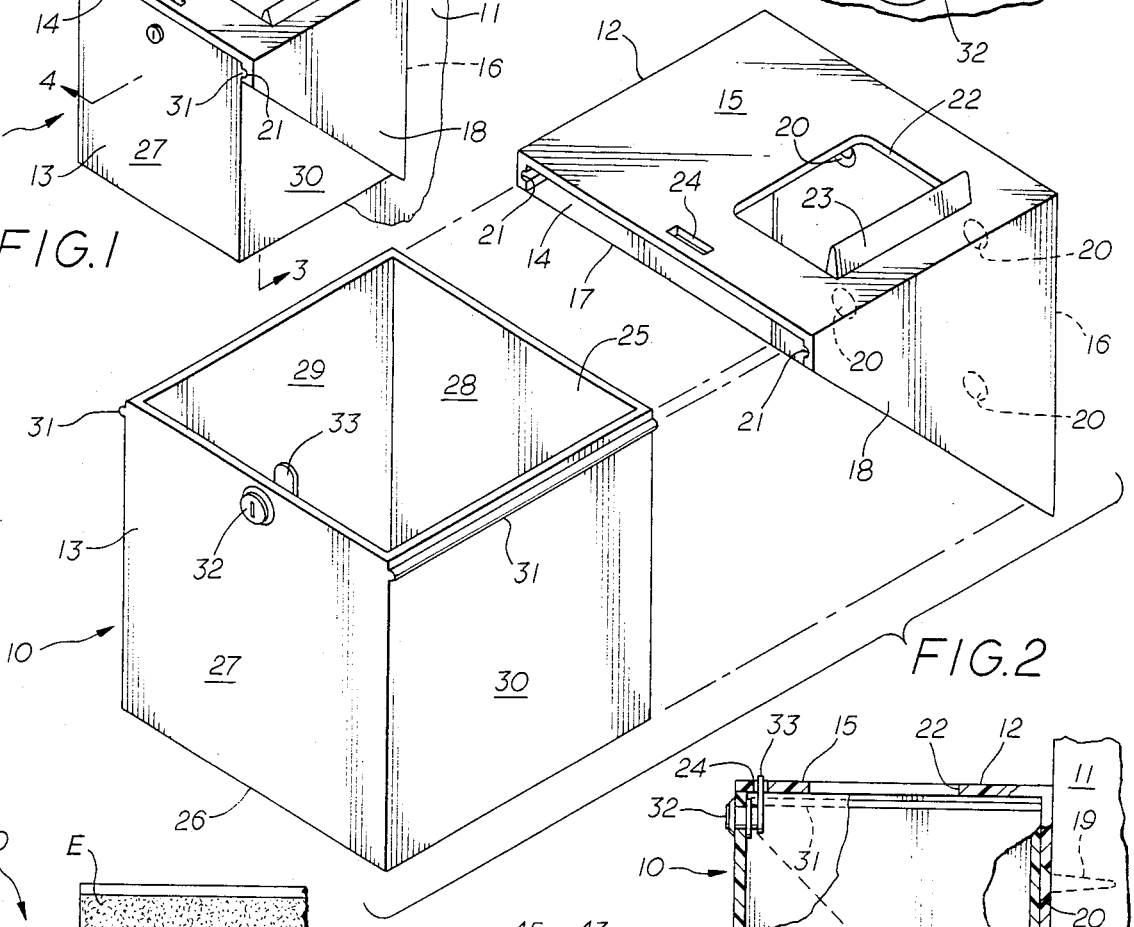
FIG. 2 is an exploded isometric view of the cleaner and chalk duct receptacle prior to being assembled.
Figure 3:
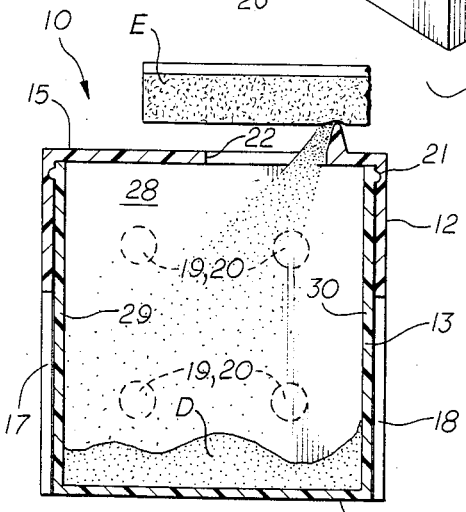
FIG. 3 is a front elevational view in cross section taken along line 3—3 of FIG. 1 of the cleaner and chalk dust receptacle.
Figure 4:
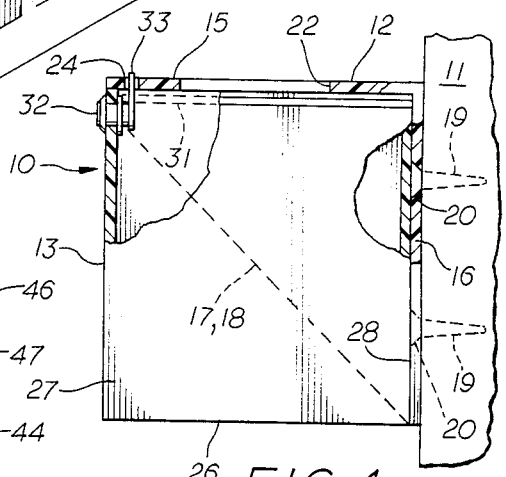
FIG. 4 is a side elevational view in cross section taken along line 4—4 of FIG. 1 of the cleaner and chalk dust receptacle.

Referring now to the drawings by numerals of reference, and particularly to FIGS. 1–5, there is shown a preferred cleaner and chalk dust receptacle for chalk board erasers 10 mounted on a wall 11 (FIGS. 1 and 4). The cleaner and receptacle 10 comprises a generally inverted L-shaped cover member 12 which slidably receives a box shaped container member 13 of molded plastic. The cover member 12 has an open front 14, a top wall 15, a rear wall 16, and a pair of parallel side walls 17 and 18. The side walls 17 and 18 extend rearward and angularly downward from the open front 14 to the rear wall 16.

The cover member 12 may be mounted on the wall 11 by means of screws 19 which extend through holes 20 formed in the rear wall 16. It should be understood that suitable adhesive mounting means may be used in place of the screws 19 to secure the cover member 12 to the wall 11.

The interior surface of the side walls 17 and 18 are provided with opposed parallel arcuate concave grooves 21 which extend longitudinally rearward from the open front 14 to the rear wall 16. The top wall 15 of the cover member 12 is provided with a rectangular opening 22.

A upwardly projecting scraper blade 23 is formed at one end of the opening 22 and extends upwardly from the top wall 15 and transversly between the two longitudinal sides of the opening. Each side of the blade tapers upwardly forming a longitudinal edge at their juncture. A narrow longitudinal slot 24 parallel with the longitudinal side of the opening 22 is provided in the top wall 15 adjacent the open front 14 midway between the side walls 17 and 18.

The generally box shaped container member 13 comprises an open top 25, a bottom wall 26, a front wall 27, a rear wall 28, and a pair of opposed parallel side walls 29 and 30 which connect the adjacent walls to the bottom wall. The outer surfaces of the side walls 29 and 30 are provided with opposed parallel convex arcuate beads 31 which extend longitudinally rearward from the front wall 27 to the rear wall 28. The beads 31 are disposed near the open top 25 and are in axial alignment with the grooves 21 of the cover member 12 to be slidably received therein for supporting the container member 13.

A cylinder lock 32 is mounted in the front wall 27 in operative alignment with the slot 24. The lock 32 has a tang member 33 which moves from a first unlocked position removed from the slot 24 to a second locked position extending into the slot to prevent the container member 13 from being removed from the cover member 12 by unauthorized persons.

Figure 7:
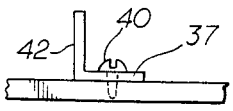
FIG. 7 is a partial side elevational view of the blade arrangement of FIG. 6.
Figure 6:
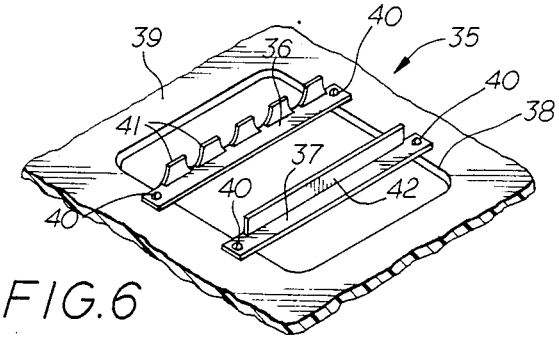
FIG. 6 is a partial isometric view of a modified blade arrangement of the cleaner and chalk duct receptacle.

FIGS. 6 and 7 show an alternate blade construction 35. In this embodiment, a pair of L-shaped spaced apart parallel blades 36 and 37 are attached transversly across the opening 38 in the top wall 39 of the cover member by means of screws 40. The upwardly extending portion 41 of the blade 36 is serrated, and the upwardly extending portion 42 of the blade 37 is smooth. The eraser is drawn across the blades 36 and 37 contacting the extended portions 41 and 42 respectively in sequence. In this manner, tightly compacted or caked chalk dust is first broken up and loosened by the serrated blade 36 and then the loosened chalk dust is scraped from the eraser by the smooth blade 37 to fall into the container through the opening 38.

Figure 8:
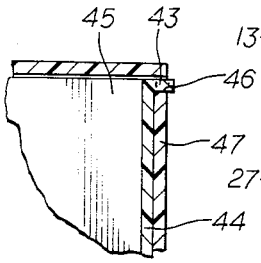
FIG. 8 is a partial front elevational view of an alternate support means for the cleaner and chalk dust receptacle.

FIG. 8 shows an alternate support configuration wherein a flange 43 extends outwardly along the container side walls 44 at their juncture with the open top 45 of the container and are slidably received within slots 46 extending along the inner surface of the cover side walls 47.

OPERATION

Referring now to FIGS. 3 and 4, the cover member 12 is secured to the wall 11 at a suitable location. The container member 13 is assembled into the cover member 12 by sliding the beads 31 into the grooves 21 until the cylinder lock tang 33 is in alignment with the slot 24. A key is inserted into the lock 32 and turned to move the tang 33 into engagement with the slot 24. To clean the eraser E, the eraser is drawn across the blade 23 and the chalk dust D is scraped from the fibers of the eraser and falls to the container 13. The lock 32 prevents the container 13 from being removed from the cover 12 by vandals or other unauthorized persons, or from being accidently spilled. When desired, the container 13 is removed by unlocking the lock 32 and the dust contained therein conveniently dumped or otherwise disposed of.

While this invention has been described fully and completely with special emphasis upon several embodiments, it should be understood that within the scope of the appended claims the invention may be practiced otherwise than is specifically described herein.

I claim:

1. A cleaner and chalk dust receptacle for chalk board erasers comprising;

a container member having an open top, a bottom wall, a back wall, a front wall, and a pair opposed side walls, said side walls provided with opposed outwardly projecting container support means extending longitudinally therealong, a cover member for receiving and supporting said container member having an open front, a top wall having an opening therethrough, a back wall, and a pair of side walls extending from said open front to said back wall, the interior surface of said side walls provided with opposed support receiving means extending longitudinally therealong, said support receiving means of said side walls of said cover member adapted to slidably receive said support means of said container member, and scraper means disposed on the top surface of said top wall to extended transversely across said opening of said top wall for scraping chalk dust from the bottom surface of said chalkboard erasers when drawn thereacross, said container to receive said scraped chalk dust into said open top through said opening in said cover member.

2. The cleaner and receptacle according to claim 1 wherein said back wall of said cover member is adapted to be mounted on a vertical wall.

3. The cleaner and receptacle according to claim 1 wherein said support means of said container member side walls comprises an arcuate convex bead formed on each said side wall near its juncture with the said open top and extending longitudinally along said each side wall from said front wall to said back wall, and said support receiving means of said cover member side walls comprises an arcuate concave groove formed on each said side wall and extending longitudinally from said open front to said back wall in axial alignment with said bead.

4. The cleaner and receptacle according to claim 1 wherein said support means of said container member side walls comprises a flange disposed on each said side wall at its juncture with the said open top and extending longitudinally along said each side wall from said front wall to said back wall, and said support receiving means of said cover member side walls comprises a slot disposed on each said side wall and extending longitudinally from said open front to said back wall in axial alignment with said flange.

5. The cleaner and chalk dust receptacle according to claim 1 wherein said scraper means comprises at least one vertically extending blade portion formed on the top surface of said top wall.

6. The cleaner and chalk dust receptacle according to claim 1 wherein said scraper means comprises at least one vertically extending blade member attached to the top surface of said top wall.

7. The cleaner and chalk dust receptacle according to claim 1 wherein said scraper means comprises a first blade member for loosening compacted chalk dust and a second cooperative blade member for scraping said loosened chalk dust from the bottom surface of said eraser.

8. A cleaner and chalk dust receptacle according to claim 1 further comprising a lock means disposed on said container member and cooperatively received by said cover member to prevent removal of said container by unauthorized persons.

9. The cleaner and chalk dust receptacle according to claim 1 wherein said opening through said top wall is disposed near one end of said top wall.

10. The cleaner and chalk dust receptacle according to claim 1 wherein said opening through said top wall is centrally disposed in said top wall.

* * * * *